US005640461A

United States Patent [19]

Ebert et al.

[11] Patent Number: 5,640,461

[45] Date of Patent: Jun. 17, 1997

[54] VIBRATION REDUCING RADIO SPEAKER ASSEMBLY

[75] Inventors: Robert C. Ebert, Chicago; Randall P. Chambers, Schaumburg; Jesus Borja, GlenView; Albert E. Binkus, Bensenville, all of Ill.

[73] Assignee: Motorola, Inc., Schaumburg, Ill.

[21] Appl. No.: 444,630

[22] Filed: May 19, 1995

[51] Int. Cl.[6] ..... H04R 25/00

[52] U.S. Cl. ..... 381/188; 181/150; 381/87; 381/205

[58] Field of Search ..... 381/188, 205, 381/87, 88, 90; 455/347, 348, 349, 350, 351; 181/150, 199

[56] References Cited

U.S. PATENT DOCUMENTS

| | | | |
|---|---|---|---|
| 2,838,607 | 6/1958 | Olson et al. | 381/205 |
| 4,337,380 | 6/1982 | Tezuka et al. | 381/205 |
| 4,439,643 | 3/1984 | Schweizer | 381/188 |
| 4,453,047 | 6/1984 | Thompson | 181/150 |
| 4,550,796 | 11/1985 | Tomita | 181/141 |
| 4,815,558 | 3/1989 | Krainhofer | 181/141 |
| 4,845,760 | 7/1989 | Awakowicz et al. | 381/188 |
| 4,853,966 | 8/1989 | Skrzycki | 381/188 |
| 4,984,268 | 1/1991 | Brown et al. | 381/188 |
| 4,993,511 | 2/1991 | Hiraki et al. | 381/188 |
| 5,054,079 | 10/1991 | Frielingsdorf et al. | 381/205 |
| 5,081,674 | 1/1992 | Wijas et al. | 381/188 |
| 5,274,701 | 12/1993 | Schmidt et al. | 381/188 |
| 5,414,229 | 5/1995 | Rocheleau et al. | 381/188 |
| 5,452,365 | 9/1995 | Kalis | 381/188 |
| 5,535,285 | 7/1996 | Jwo | 381/205 |

*Primary Examiner*—Curtis Kuntz
*Assistant Examiner*—Rexford Barnie
*Attorney, Agent, or Firm*—Frank M. Scutch, III

[57] ABSTRACT

A vibration reducing radio speaker assembly (100) located within a radio housing (101). The radio speaker assembly (100) includes a speaker grommet (105) having an aperture (111) and notched portions (115) which extend along the lateral sides of the grommet (105). The grommet (105) holds a speaker (103) and frictionally engages within the aperture located in the interior of the grommet (105) while the notched portions (115) frictionally engage with rib member (119) which protrude from the radio housing (101). The speaker assembly (100) provides reduced acoustic vibration and enhances audio quality since the speaker (103) is not directly fastened to the radio housing (101).

12 Claims, 3 Drawing Sheets

VIBRATION REDUCING RADIO SPEAKER ASSEMBLY

TECHNICAL FIELD

This invention relates in general to radio assemblies and more specifically to vibration reduction.

BACKGROUND

Many techniques have been developed for mounting various mechanical and/or electrical assemblies within a radio housing. These techniques often involve mechanically attaching a device such as a printed circuit board or speaker using screws or other attachment mechanisms to one or more internal sections of the radio. Although this type of attachment initially provides a rigid structure, which securely holds the attached components, many problems arise using this method.

The continual and necessary movement of speaker elements during speaker operation causes small amounts of vibration throughout the radio housing. This vibration not only tends to loosen various mechanical and electrical parts, components and interconnections over time. Additionally, this can also promote audio phenomenon known as acoustic regeneration, microphonics and/or "howling".

Acoustic regeneration occurs when an internal transducer or speaker causes other portions of a device to vibrate. This vibration causes these parts or devices to make noise which is undesirable. This noise can rise to the point where it interferes and/or overtakes the audio coming from the speaker. Obviously, this interference in the desired audio characteristics output from the radio's speaker affects the audio quality and intelligibility of the radio signals received and information being conveyed. Thus, the need exists to provide a mounting assembly which helps to eliminate the unwanted vibration and acoustic regeneration produced in a mobile or portable radio which is exposed to high degree of movement and vibration.

DETAILED DESCRIPTION OF THE PREFERRED EMBODIMENT

Figure 1:
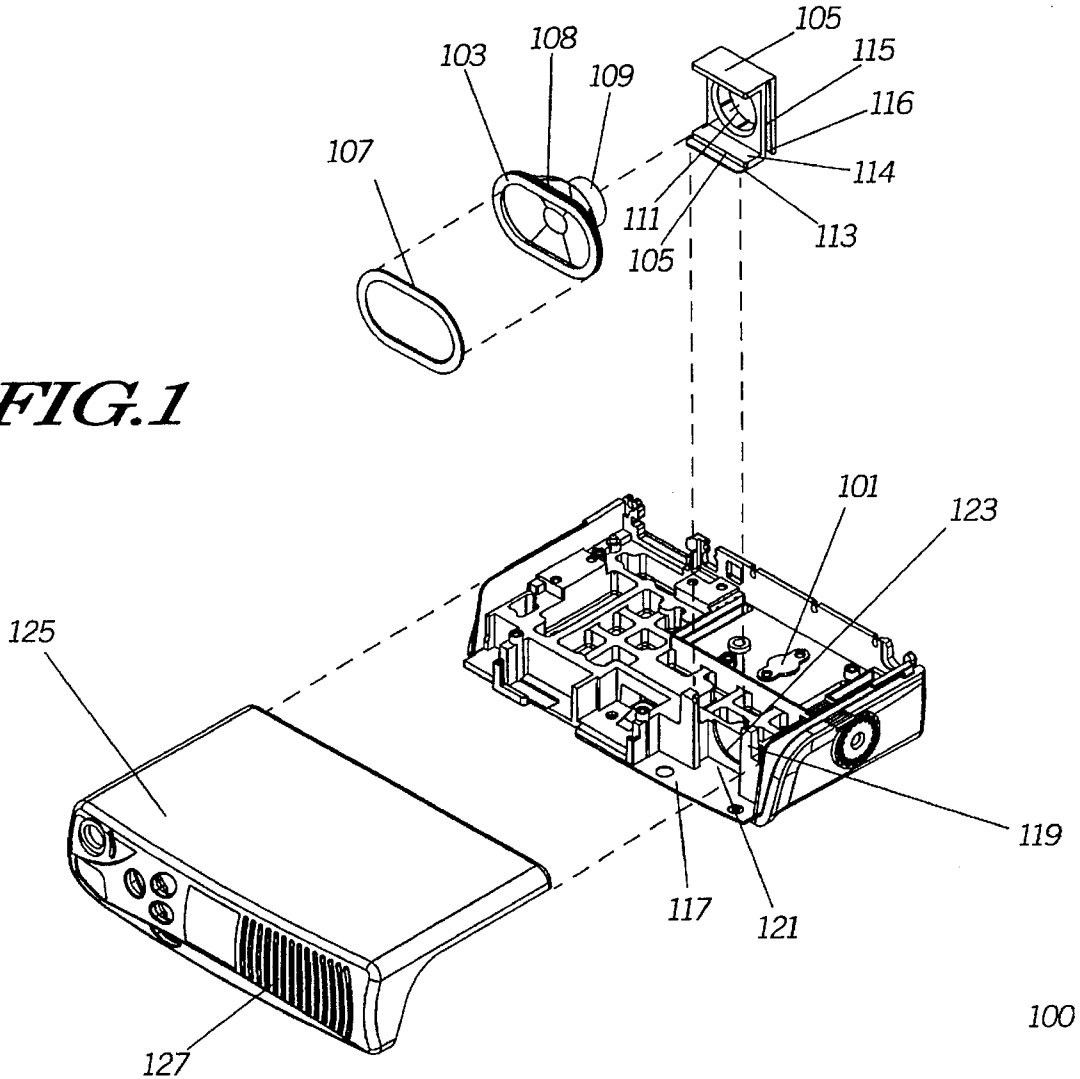
FIG. 1 is an exploded view of the vibration reducing radio speaker assembly according to a preferred embodiment of the invention.
Figure 2:
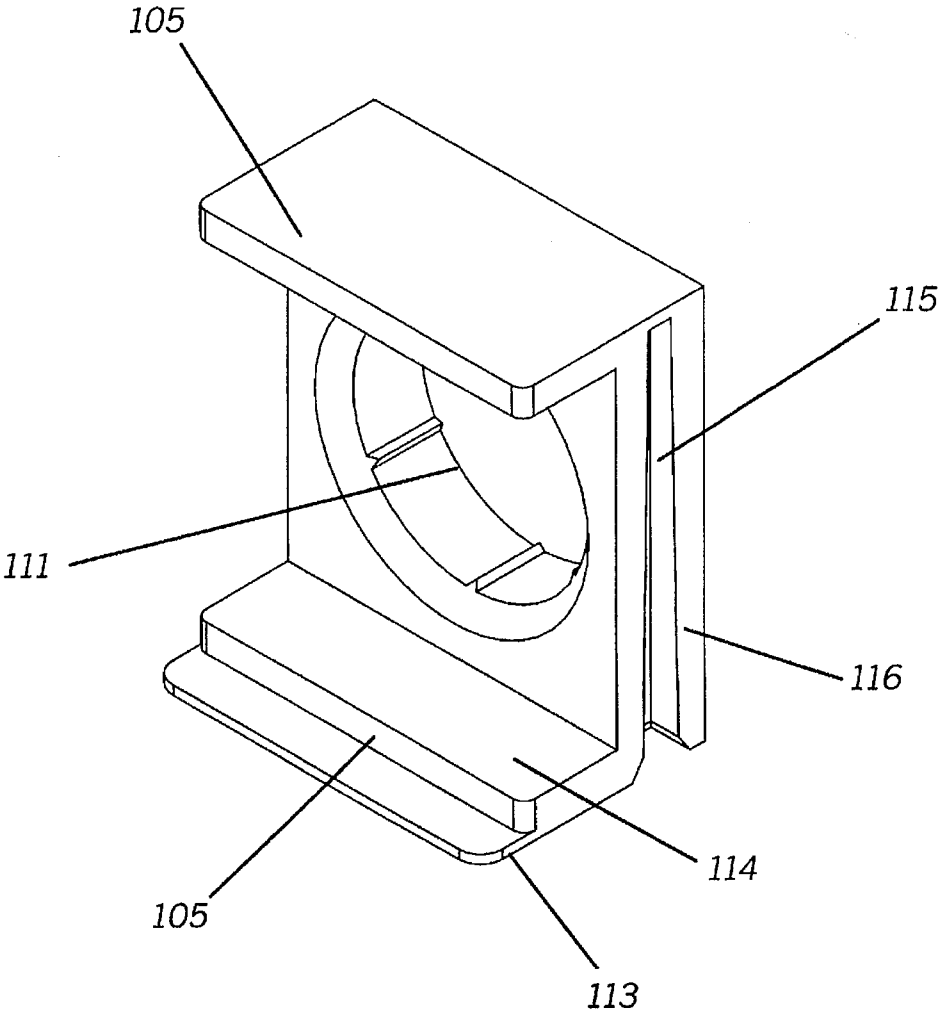
FIG. 2 is an enlarged view of a grommet used in a preferred embodiment of the invention.
Figure 3:
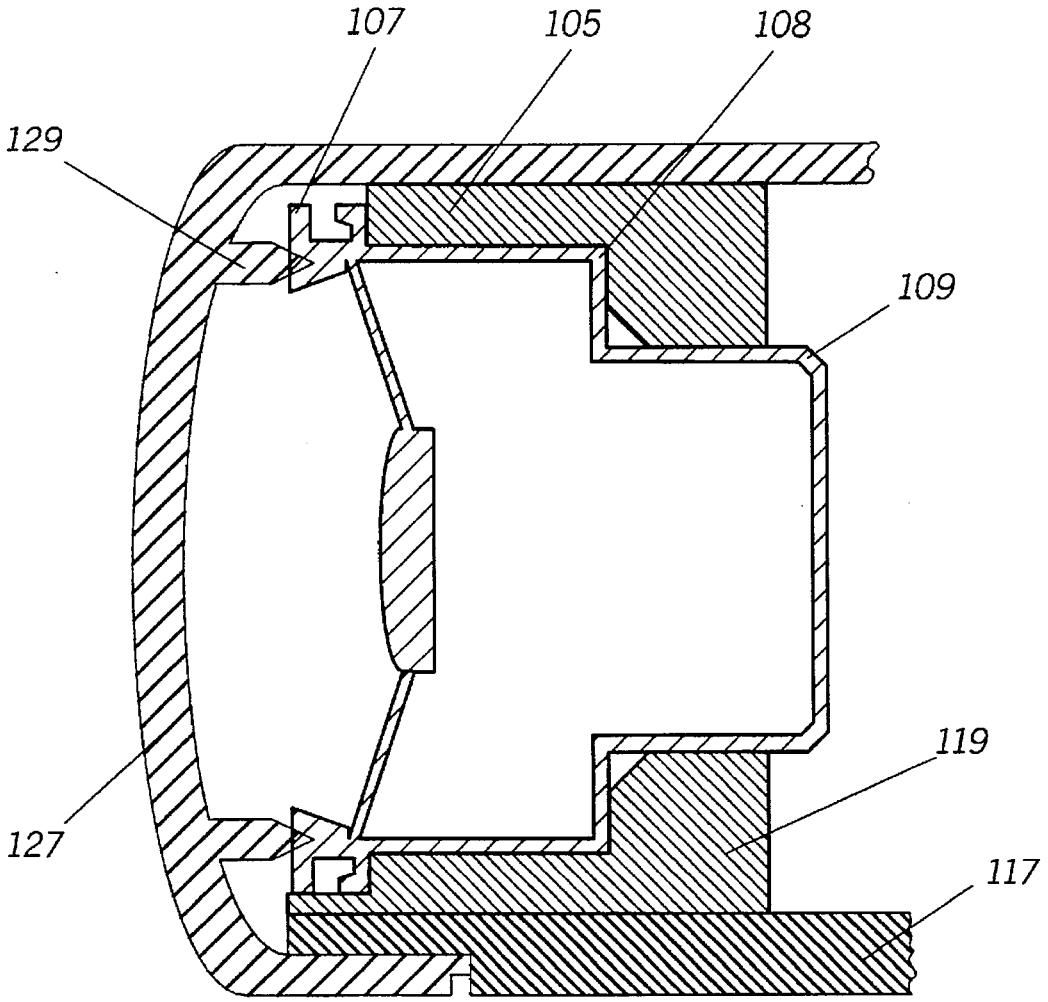
FIG. 3 is a side cross-sectional view of the radio speaker assembly showing the speaker and grommet mounted in the radio case.

Referring now to FIGS. 1–3 a vibration reducing radio speaker assembly 100 is shown and is typically located within a radio housing 101. Although radio housing 101 is shown as used in a mobile radio, it should be evident to those skilled in the art that the present invention may also be used in a portable radio embodiment or any type of electronic device requiring a communications speaker.

The radio speaker assembly 100 includes a speaker 103, speaker grommet 105 and speaker gasket 107. The speaker 103 is a standard transducer for audio type communications and includes a basket portion 108 and magnet portion 109. The speaker grommet 105 is made of a flexible rubber or like material and includes and circular aperture 111 located substantially in its center. A plurality of winged edges 113 and notch portions 115 are used to engage the speaker grommet 105 within a rib member assembly 117. Notch portions 115 extend along the lateral sides of the speaker grommet 105 and are formed by a forward section 114 and rearward section 116 of the speaker grommet 105 which are molded to create each of the respective notches.

The rib member assembly 117 includes a plurality of rib members 119 which protrude upward from the lower surface 121 of the radio housing 101. Both rib members 119 form substantially a c-shape and are used to frictionally engage speaker grommet 105. This is accomplished using notch portions 115, where each of rib members 119 is sized to slide and engage with notch portions 115 to securely hold the speaker grommet 105 into a fixed position. The rib member assembly 117 further includes a cut-out or indented area 123 which allows the magnet portion 109 to project rearward through the rib member assembly 117 without contacting any surface of the radio housing 101. This allows the speaker to operate normally without mechanical contact to the radio housing 101 thereby preventing any undesired vibrations which would ultimately lead to audio distortion.

In its assembled condition noted by the phantom lines, the magnet portion 109 is inserted through circular aperture 111 where it is frictionally retained therein. The rib member 119 are inserted into notch portions 115 of the speaker grommet 105. As noted in FIG. 1, the speaker grommet is molded to provide a front and rear half which creates the notch portions 115. Thus, the speaker 103 is suspended and held into a fixed position without mechanically contacting the housing 101. This enhances the audio provided by the speaker 103 since little or no acoustic vibrations are present to distort the audio or loosen the mechanical assembly over an extended period of time the speaker 103 is in use.

Finally, the case 125 is used to protect the internal parts of the radio. The case 125 includes a speaker grill 127 which provides a means by which audio protected from the speaker 103 can escape from the case 125 without being muffled or distorted. On the inside surface of the speaker grille 127, a retaining members 129 are used to provide a biasing force against the speaker gasket 107 when the case 125 is in the proper assembled condition. The speaker gasket 107 is made of a flexible rubber or the like and is used to provide a compressive seal against the inside surface of the speaker grill 127 for dampening vibrations induced by the speaker grill as it presses against the speaker 103. The case 125 provides an evenly distributed biasing force around the perimeter of the speaker 103 to firmly hold the speaker 103 in compression within the speaker grommet 105 providing little to no acoustic regeneration or vibration.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. A vibration reducing radio speaker assembly located within a radio housing comprising:

a transducer for supplying audio from an electrical circuit from a radio;

a grommet having an aperture, at least one fastening wing, and at least one notched section; and wherein the transducer frictionally engages within the aperture and the at least one fastening wing and further wherein the at least one notched section frictionally engages with a portion of the radio housing to fixedly attach the transducer into a substantially fixed position.

2. A vibration reducing radio speaker assembly as in claim 1 wherein the transducer includes a basket and magnet and further wherein the radio speaker assembly further comprises a gasket which surrounds an outer portion of the basket for reducing vibration and providing a seal.

3. A vibration reducing radio speaker assembly as in claim 1 wherein the notched sections are positioned along opposite sides of the grommet.

4. A vibration reducing radio speaker assembly as in claim 1 wherein the transducer is a substantially circular speaker.

5. A vibration reducing radio speaker assembly as in claim 1 wherein the grommet is made of a flexible material for providing compression against the speaker when inserted into the at least one notched section.

6. A vibration reducing radio speaker assembly as in claim 1 wherein the at least one notched section engages with a rib member assembly attached to the radio housing.

7. A vibration reducing radio speaker assembly as in claim 6 wherein the rib member assembly comprises a plurality of members forming a substantially c-shape for engaging with the grommet.

8. A radio speaker assembly used in a radio comprising:

a plurality of rib members;

a flexible grommet having circular aperture, a plurality of winged sections, and a plurality of notched sections wherein the notched sections frictionally engage with the plurality of rib members; and a speaker frictionally supported within the circular aperture and held into a fixed position by the plurality of winged sections for providing audio therefrom.

9. A radio speaker assembly as in claim 8 wherein the speaker includes a basket portion and a magnet portion, the magnet portion engaging with the circular aperture of the flexible grommet.

10. A radio speaker assembly as in claim 9 further comprising:

a gasket which extends around a perimeter of the basket portion for engaging with a radio housing to provide insulation from vibration.

11. A radio speaker assembly as in claim 8 wherein the plurality of rib members form a substantially c-shape.

12. A radio speaker assembly as in claim 8 wherein the plurality of notched sections extend along opposite sides of the flexible grommet.

* * * * *